US007850903B2

(12) United States Patent
Kummer et al.

(10) Patent No.: US 7,850,903 B2
(45) Date of Patent: Dec. 14, 2010

(54) TAPPING CHANNEL FOR A METALLURGICAL FURNACE

(75) Inventors: Karl-Heinz Kummer, Duisburg (DE); Horst-Dieter Borgwardt, Dorsten (DE); Jürgen Kunze, Xanten (DE)

(73) Assignee: SMS Siemag Aktiengesellschaft, Dusseldorf (DE)

( * ) Notice: Subject to any disclaimer, the term of this patent is extended or adjusted under 35 U.S.C. 154(b) by 379 days.

(21) Appl. No.: 11/990,155

(22) PCT Filed: Jul. 11, 2006

(86) PCT No.: PCT/EP2006/006745

§ 371 (c)(1),
(2), (4) Date: Feb. 7, 2008

(87) PCT Pub. No.: WO2007/019917

PCT Pub. Date: Feb. 22, 2007

(65) Prior Publication Data

US 2010/0127023 A1 May 27, 2010

(30) Foreign Application Priority Data

Aug. 12, 2005 (DE) ..... 10 2005 038 172

(51) Int. Cl.
*F27D 3/15* (2006.01)

(52) U.S. Cl. ..... 266/241; 266/46

(58) Field of Classification Search ..... 266/241, 266/46, 236; 222/592
See application file for complete search history.

(56) References Cited

U.S. PATENT DOCUMENTS 4,498,610 A * 2/1985 Wooding ..... 222/592

FOREIGN PATENT DOCUMENTS

| | | |
|---|---|---|
| DE | 34 27 268 | 3/1985 |
| DE | 199 60 717 | 6/2001 |
| EP | 0 688 875 | 7/1999 |
| JP | 5 33 15 21 | 12/1993 |

* cited by examiner

*Primary Examiner*—Scott Kastler
(74) *Attorney, Agent, or Firm*—Lucas & Mercanti, LLP; Klaus P. Stoffel

(57) ABSTRACT

The invention relates to a tapping channel (1) for a metallurgical furnace, particularly for an electro-reducing furnace, comprised of at least one tapping brick (10, 11, 12) and of a cooling device in the vicinity of the tapping channel (1). The cooling device is provided in the form of a sleeve (14), which indirectly cools a tapping brick (2) and which at least partially surrounds the furnace wall (3) in the vicinity thereof.

8 Claims, 2 Drawing Sheets

TAPPING CHANNEL FOR A METALLURGICAL FURNACE

The invention concerns a tapping channel for a metallurgical furnace, especially an electric arc reduction furnace, which consists of at least one tap hole brick and a cooling device in the vicinity of the tapping channel.

Patent Abstracts of Japan 05-33 15 21 discloses a tapping channel in which the cylindrical tapping channel consists of a jacketed copper pipe that is provided with cooling channels. The jacketed pipe is inserted in a bore in the sidewall of the furnace using a filling compound for positioning in such a way that the end wall of the jacketed pipe ends flush with the inside wall of the furnace.

The following statement appears on page 12, left column, of the SMS Demag publication "Success with SAF Technology":

Design of the Tap Holes

The tap holes can be offered in conventional designs. For use under high stress, water-cooled elements are available for the tapping of metal, copper matte, and slag.

It is also well known that the tap hole bricks of the tapping channel in the furnace lining become eroded—the wall structure is destroyed. As a result, the thermal conductivity and the tightness in the vicinity of the tapping channel are no longer guaranteed. Since the furnaces are operated continuously, the damaged and worn tap hole bricks must be regularly repaired/-replaced. The furnace must be shut down to carry out the repair-/replacement work. This results in production interruptions. To keep these production interruptions as short as possible, it is advantageous to carry out the repair/replacement work on the tapping channel or tap hole bricks while high temperatures are still present inside the furnace. When the work is carried out in this way, the area around the tapping channel is not cooled. This manner of carrying out the work is illustrated in FIGS. 1 and 2.

In other well-known types of tapping channels, the tapping channels are directly cooled, and the cooling medium, preferably water, is carried in the tapping channels as far as the interior of the furnace and further conducted as far as the area of the furnace lining. Therefore, when damage is present in the tapping channel, the cooling medium can enter the furnace.

The objective of the invention is to improve the previously known tapping channels, especially with respect to their stability and service life, and to eliminate the disadvantages specified above. The improved design of the tapping channel is also intended to simplify the necessary maintenance work and to improve safety.

In accordance with the invention, this objective is achieved by virtue of the fact that, in a tapping channel of the type specified in the introductory clause of Claim 1, the cooling device is designed as a jacket that surrounds the tap hole bricks in the vicinity of the furnace wall.

Further refinements of the tapping channel are described in the dependent claims.

The decisive advantage of the tapping channel of the invention lies in the fact that the tap hole bricks are not surrounded over their entire length by the jacket. The tap hole brick facing the interior of the furnace (in the case of a multiple-piece design) or the section of the tap hole brick that faces the interior of the furnace (in the case of a one-piece design) is not surrounded by the jacket. This tap hole brick ends flush with the lining of the furnace.

In the tapping channel of the invention, the cooling medium is carried only from the outside to or into the jacket, which is made of copper. The tapping channel is indirectly cooled due to the high thermal conductivity of the copper jacket. No cooling medium is carried into the interior of the furnace, since the cooling channels in the jacket are located only outside the furnace casing.

The erosion that naturally occurs due to exposure to hot slag/metal, etc., is minimized by the jacket, and the preconfigured form of the tapping channel is preserved.

Furthermore, the position/location of the tap hole is well defined. The lining around the tap hole remains intact. The consumed/worn tap hole bricks can be easily removed.

The cooling device of the invention, i.e., the jacket, allows simple/easy installation of the new tap hole bricks, and inexpensive standard brick formats can be used.

The jacket provides intensive cooling that extends into the interior of the furnace and allows the molten charge to solidify faster. This in turn allows faster and safer access to the tap hole. The improvements described above eliminate or reduce furnace shutdown times.

A specific embodiment of the invention and a prior-art embodiment are described in detail below with reference to highly schematic drawings.

Figure 1:
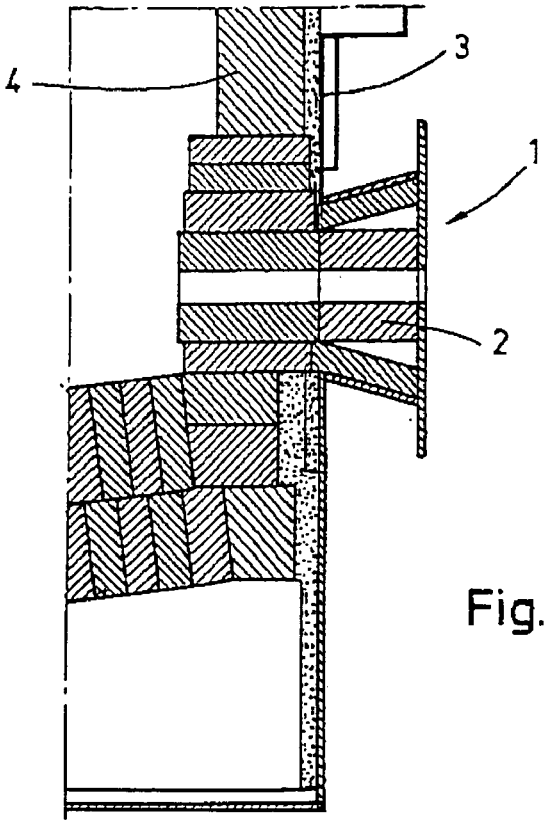
FIG. 1 shows a cross-sectional side view of a tapping channel of a previously known design.

FIG. 1 shows a well-known design of a tapping channel 1, which is arranged in a tap hole 2 of a furnace, which consists of a furnace wall 3 and furnace lining 4.

Figure 2:
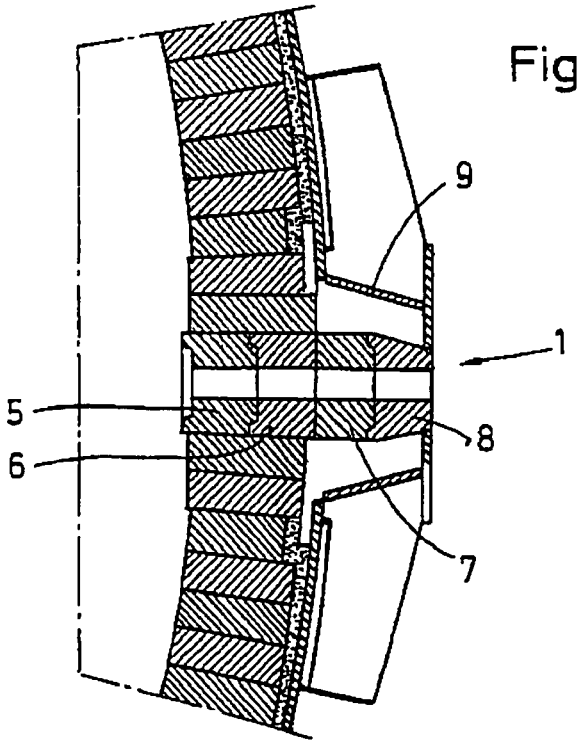
FIG. 2 shows a cross-sectional top view of the tapping channel in FIG. 1.

FIG. 2 shows a cross-sectional top view of the tapping channel in FIG. 1. In the illustrated embodiment, the tapping channel 1 consists of several tap hole bricks 5, 6, 7, 8. The tap hole brick 1 faces the interior of the furnace, and the tap hole bricks 7, 8 are located outside the furnace wall 3 and are surrounded by a sheet-metal structure 9 for stabilization.

Figure 3:
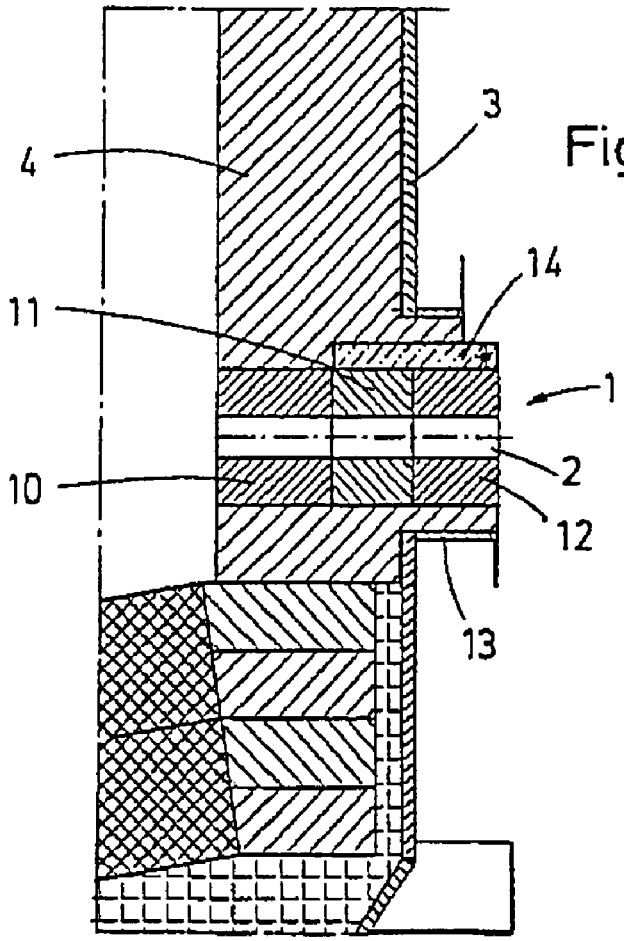
FIG. 3 shows a cross-sectional side view of a tapping channel of the invention.

FIG. 3 shows a cross-sectional side view of the tapping channel 1 of the invention. Three tap hole bricks 10, 11, 12 are installed in a tap hole 2, and the tap hole brick 10 that faces the interior of the furnace ends flush with the lining 4 of the furnace. The outer tap hole brick 12, which faces away from the furnace, extends beyond the furnace wall 3. For this purpose, a shoulder 13 is mounted on the furnace wall to support the tap hole brick 12. In the vicinity of the furnace wall 3, the tap hole bricks 11, 12 are surrounded by a cooling device in the form of a jacket 14. The jacket 14 ends flush with the end face of the tap hole brick 12 on the outside of the furnace. The jacket 14 extends partially into the lining 4 of the furnace. As illustrated in the drawing, the area directly on the inner wall of the furnace is not covered by the jacket 14. For example, the last tap hole brick 10 facing the interior of the furnace is not surrounded by the jacket.

Figure 4:
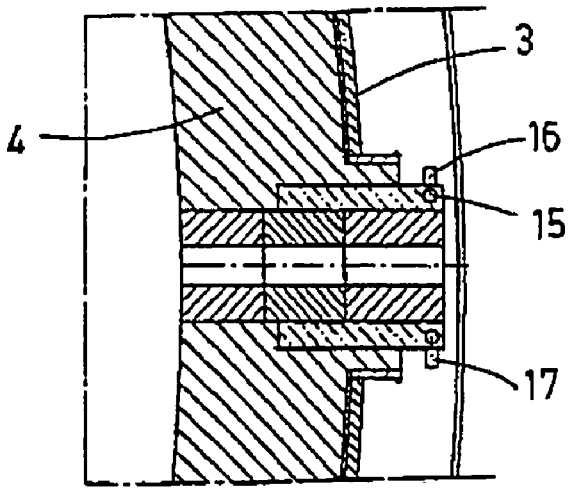
FIG. 4 shows a cross-sectional top view of the tapping channel in FIG. 3.

FIG. 4 shows a cross-sectional top view of the tapping channel 1. The jacket 14, which, consists, for example, of solid copper, is furnished with a cooling channel 15 in its area that projects outward from the furnace wall 3. In the embodiment illustrated here, the cooling channel 15 has an annular design. Connections 16, 17 for supplying and removing the cooling water are provided in the sidewalls of the jacket 14.

LIST OF REFERENCE NUMBERS

1 tapping channel
2 tap hole
3 furnace wall
4 lining
5 tap hole brick
6 tap hole brick
7 tap hole brick
8 tap hole brick
9 sheet-metal structure
10 tap hole brick
11 tap hole brick
12 tap hole brick
13 shoulder
14 jacket
15 cooling channel
16 connection
17 connection The invention clamed is:

1. A tapping channel (1) for a metallurgical furnace, which consists of at least one tap hole brick (10, 11, 12) that forms a length of the tapping channel, and a cooling device in the vicinity of the tapping channel (1), wherein the cooling device is designed as a jacket (14) that indirectly cools at least one tap hole brick (10, 11, 12) and at least partially surrounds the one or more tap hole bricks in the vicinity of the furnace wall (3), that the jacket (14) is constructed to extend partially into the lining (4) of the furnace, and that the jacket (14) is designed with a peripheral cooling channel (15) along at least a portion of its periphery only in its an end area that projects outward from the furnace wall (3), wherein a last tap hole brick (10) or a brick section facing an interior of the furnace is not surrounded by the jacket (14).

2. A tapping channel (1) in accordance with claim 1, wherein the jacket (14) is made of a thermally conductive material.

3. A tapping channel (1) in accordance with claim 2, wherein the jacket (14) is made of copper.

4. A tapping channel (1) in accordance with claim 1, wherein the jacket (14) has a one-piece design.

5. A tapping channel (1) in accordance with claim 1, wherein the jacket (14) has a multiple-piece design.

6. A tapping channel (1) in accordance with Claim 1, wherein the jacket (14) is constructed with several peripheral cooling channels (15).

7. A tapping channel (1) in accordance with claim 1, wherein the jacket (14) is constructed with connections (16, 17) for supplying and removing a. cooling medium.

8. A tapping channel (1) in accordance with claim 1, wherein the jacket (14) is constructed so as to end flush with the end face of the tap hole brick (12) on the outside of the furnace.

* * * * *